United States Patent [19]

Sangree

[11] 4,406,606

[45] Sep. 27, 1983

[54] APPARATUS FOR PRODUCING SOIL BUILDING BLOCKS

[76] Inventor: Harry C. Sangree, 58 Vine Ave., Craigville, Mass. 02636

[21] Appl. No.: 268,809

[22] Filed: Jun. 1, 1981

[51] Int. Cl.[3] ..... B30B 5/02

[52] U.S. Cl. ..... 425/351; 425/416; 425/422

[58] Field of Search ..... 425/358, 412, 422, 416, 425/351

[56] References Cited

U.S. PATENT DOCUMENTS

| | | | |
|---|---|---|---|
| 761,886 | 6/1904 | Helm | 425/351 |
| 1,310,359 | 7/1919 | Mannell | 425/416 |
| 1,573,336 | 2/1926 | Van Anden | 425/412 |
| 2,400,851 | 5/1946 | Steinmueller | 425/412 |
| 2,962,788 | 12/1960 | Romirez | 425/416 |
| 4,157,887 | 6/1979 | Sothje | 425/412 |

*Primary Examiner*—John A. Parrish
*Attorney, Agent, or Firm*—Mary O. Stauss

[57] ABSTRACT

The present invention is a device to produce manually compressed soil-cement blocks faster and more efficiently than previous devices of this type. The apparatus consists of a rectangular box connected to partially slotted supports, a cover to hold the mixture in the box during compression, a sliding plate to do the compression and a toggle linkage to create mechanical advantage necessary to convert human energy input into useful work. The toggle linkage is connected to toggle-connecting bars which are joined to wing pieces which connect to a lever actuated by a handle located on one side of the machine. Downward swinging of the handle causes the mechanism to move the sliding plate up and compress the soil between the fixed cover and advancing sliding plate.

2 Claims, 4 Drawing Figures

APPARATUS FOR PRODUCING SOIL BUILDING BLOCKS

BACKGROUND OF THE INVENTION

Adequate shelter is a basic need for survival, yet millions throughout the world live in inadequate housing. It is dangerous to their health, hurtful to their spirits, and contrary to all development goals. The problem persists because of its magnitude. A massive effort will be required to make progress against it.

Stabilized soil is a building material which can cut building costs substantially below those of traditional concrete-block methods. Its problem is that it must be compacted with between 400 and 700 psi to be suitable for construction use. In rural areas, this must be accomplished through manual means in a process which can produce a house quickly. The method utilized must be transportable to any location by mule and must be able to withstand abuse by nature and man. It must be enough to be repaired in the field, but clever enough to use mechanical advantage to convert human muscle into solid bricks. *Construire en Terre* (CRATerre, Groupement Graphique GAMMA: Paris 1979) summarizes the 14 manually-powered designs available on the world market (p. 140) and describes in detail the 5 commercially available models. The maximum available production rate now available of standard-sized construction bricks (29.3×14.0×8.9 cm) is 425 blocks per day. This translates into one house every two weeks per machine. When Calcutta has 1,700,000 homeless squatters officially reported and Indonesia admits to a housing shortage of 16 million dwellings, this is not an acceptable rate.

PRIOR ART

U.S. Pat. No. 2,962,788 (patented Dec. 6, 1960 by Ramirez) is marketed as the Cinva-Ram. A machine marketed as the Ellson Blockmaster is used in India. Neither these machines nor their successors can produce bricks quickly enough with an easily transportable mechanism to be an answer to every housing problem in the world. These machines differ from the inventive apparatus.

SUMMARY OF THE INVENTION

The present invention provides for a machine that can produce an estimated 750 bricks per day. It produces bricks of the same compressive quality as competitors with a device as light as the lightest of the presently available designs. It improves the harnessing of human motion so that no energy or time is wasted.

In operation, soil cement is placed in the machine box and the cover is closed. A force is put on the end of the machine handle. This pulls two toggles (located under the machine) inward, which raises a sliding plate inside of the box. The soil is compressed between the moving sliding plate and the fixed cover. The brick is fully compressed when the handle is parallel to the ground.

When the handle is fully actuated and the plate is fully elevated an eccentric linkage locks into a vertical position. The cover is removed. The lever is returned to the vertical position with the eccentric linkage staying locked. This pushes the sliding plate to the top of the box and pushes the completed block out of the box. The block is taken away and cured. The locked linkage is unkinked and gravity pulls the sliding plate down to its original position. The machine is ready to repeat the cycle.

It is an important object of the present invention to provide a new, inexpensive, hand-operable brick or block making machine.

Another important object of the present invention is the provision of new and improved apparatus for the compression of brick-forming ingredients by the subjection of the ingredients to mechanical pressure applied through a lever to two pairs of mirror-oriented toggles in a manner which makes high block production possible.

It is a further object of this invention to provide a block-making apparatus wherein block-forming ingredients are compressed between a cover and a piston by movement of a sliding plate reacting against a fixed cover.

Still another important object is a block making machine which confines all labor input to one side of the machine so that blocks can be conveniently made by one operator. All steps end at convenient points so that only two hands are required.

It is yet another object to provide a block-making machine wherein all lever motion produces useful work. Downward motion is converted into soil mixture compression. Upward lever motion is converted into block ejection. Gravity is utilized to return to the base position.

Further, it is meant to utilize a mechanical device that generates mechanical advantage in a way that is compatible with that needed to compress typical soil-cement mixtures. Little energy is wasted and the human effort invested is most profitably used.

Other objects, features and advantages of the invention will become apparent from the following specification taken in conjunction with the accompanying drawings wherein.

Figure 1:
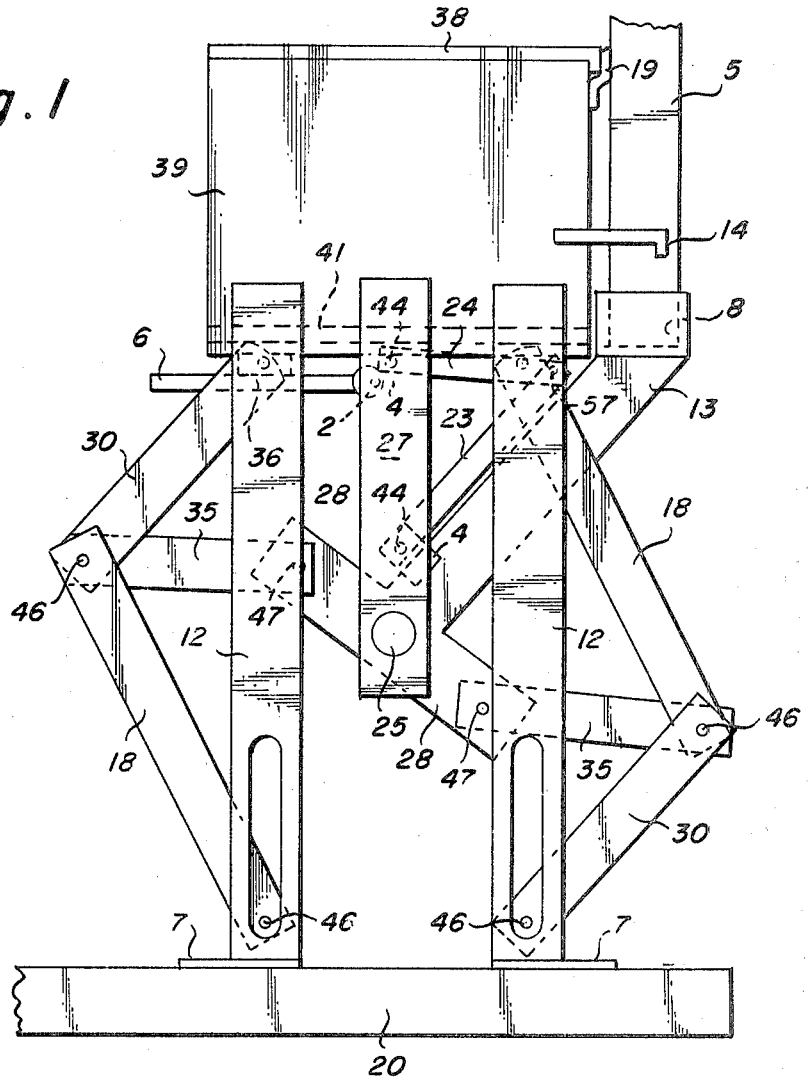
FIG. 1 is a side view of the apparatus in its initial position.
Figure 3:
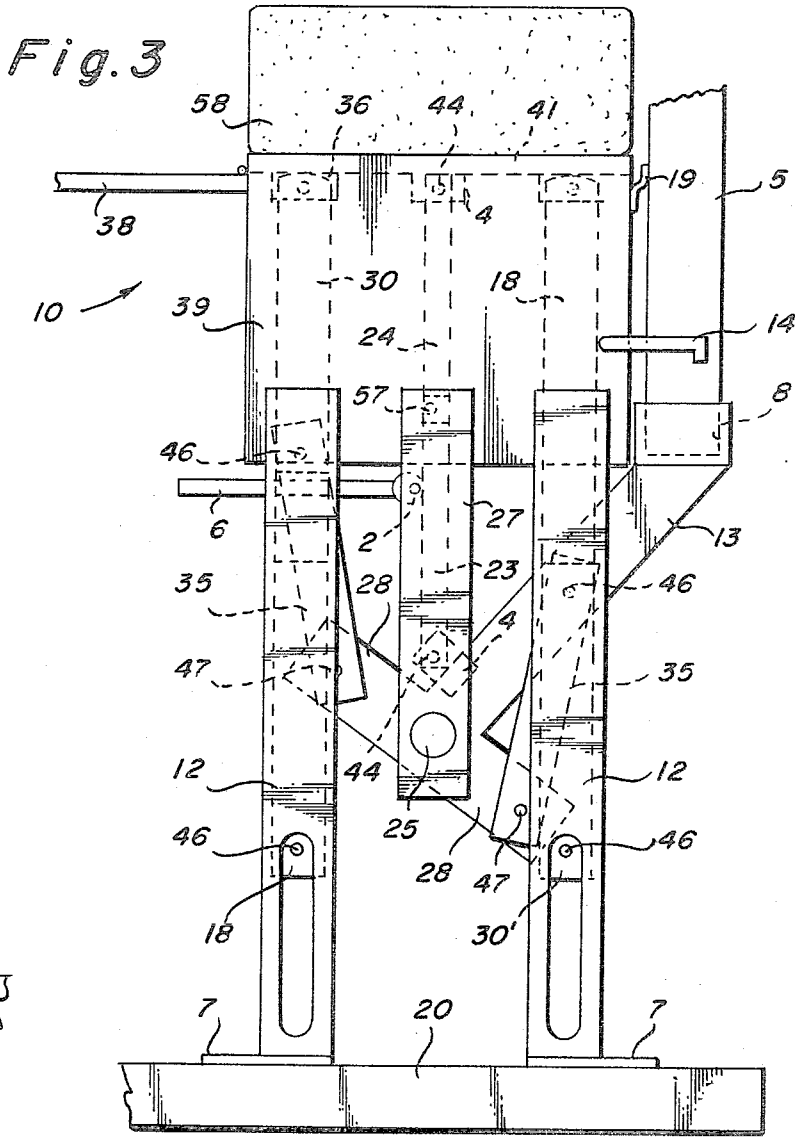
FIG. 3 is a side view of the apparatus in its fully ejecting position.
Figure 2:
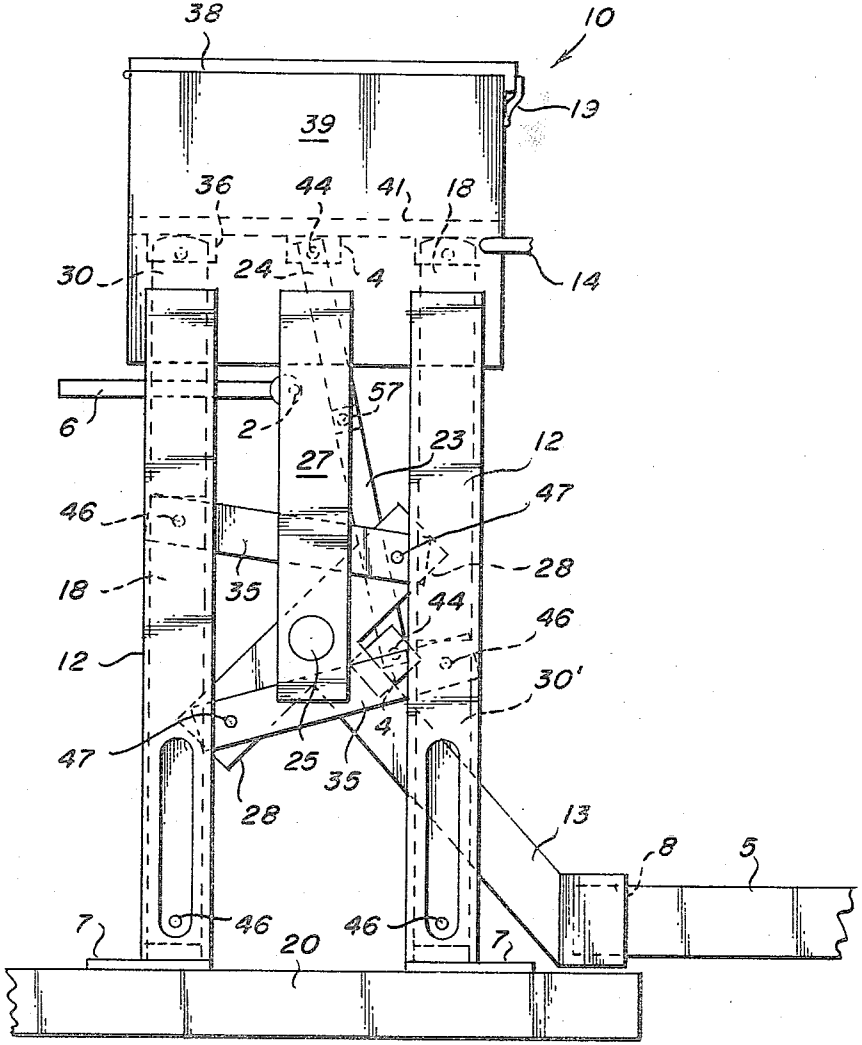
FIG. 2 is a side view of the apparatus in its fully compressed position.

Block-producing apparatus 10 is shown in FIGS. 1, 2 and 3. Apparatus 10 is generally supported on base 20 of convenient size and shape. This may be made of wood or concrete and is supported above or at ground level by available means.

Rectangular four-sided box 39 is supported by four partially slotted legs 12. The legs 12 are connected to foot pads 7 which are firmly attached to the fixed base 20. Leg 12 location and box 39 size depend on the size of blocks desired.

At the center of each long side of the box 39 is a vertical pivot support bar 27 which hangs down. Near the end of both pieces is a round hole in which fits a pivot bar 25 which is machined at both ends, but remains rectangular in its middle section. The pivot bar is located on the center short axis of the rectangular box under the box 39. Connected to the pivot bar 25 is the lever 13 which extends along the long axis of the rectangle to beyond the box 39. It has a seat 8 into which a handle 5 is placed. The handle is the activator of the entire system.

On either side of where the lever 13 connects to the pivot bar 25 are pivot wings 28. The lever 13, pivot bar 25 and pivot wings 28 are all one unit and move together with the handle. The two pivot wings 28 connect to the four toggle connecting bars 35 by a round pin 47 at each end of each wing 28. The four toggle connecting bars 35 connect to four short toggle links 30 and four long toggle links 18 with four round pins 46.

The toggles are arranged so that the short toggle link 30′ is on the bottom at the lever end of the box and the long toggle link 18 is on the bottom at the other end. The pivot wings 28 are oriented so that they have holes more or less parallel with the locations of the pivot holes of the two toggles. Both toggle sets kink away from the center of the box. The toggle arrangement can be thought of as a mirroring effect; one end arrangement is upside down and reversed from the other end so that both pivots move towards each other when the toggles are straightened.

The top toggle links 18 and 30 are connected by pins 46 and pin seats 36 to the sliding plate 41. These seats 36 are located where the imaginary line drawn between the two supports 12 of one end intersect the plate 41. In the center of the plate 41 is the ejector linkage seat 4. The upper ejector linkage link 24 is connected to this by a pin 44. The upper ejector linkage link 24 is connected to the lower ejector linkage link 23 by an eccentrically located pin 57. The pin is located such that a moment is exerted by it if a vertical force is exerted on the linkage in a vertical position. The lower ejector linkage link 23 is connected to the lever 13 by another pin-seat connection 44, 4.

The top of the box 39 can be covered by sliding a cover 38 over it. The cover 38 latches itself down to hooks 19 or is removed for changing soil-cement or ejecting the formed block.

To make a block, soil-cement is placed in the box 39 such that it is filled to the top. The handle 5 is vertical and the toggles are not vertical (FIG. 1). The cover is closed.

The handle 5 is arced downward. This causes the pivot wings 28 to rotate. The rotating pivot wings 28 pull the toggle connecting bars 35 which pull the toggle pins 46 inward. This causes the toggles to push the sliding plate 41 up and compresses the soil. The toggles 18, 30 feel a compressive force and exert a tensile force on the supports 12. This continues until the handle 5 is parallel to the ground and the toggle links 18, 30 form a straight line. While this happens, the upper ejector linkage link 24 and the lower ejector linkage link 23 also form a straight line relationship (FIG. 2).

The cover 38 is removed from the box 39. The handle 5 is arced upward. The lever 13 pushes against the lower ejector linkage link 23 which pushes the upper ejector linkage link 24 which pushes the sliding plate 41 up. Guides 59 keep the plate horizontal. The sliding plate pulls the toggles 18, 30 along in the slots provided in the supports 12. When the handle 5 is in its vertical position the sliding plate 41 is at the top of the box 39 (FIG. 3). The handle is locked in this position with the handle lock 14. The finished block 58 is taken away to be cured.

A spring-loaded cam 2 is rotated by use of an actuator 6. The cam unkinks the two ejection linkage links 23, 24 and the plate 41 and related apparatus fall by gravity to their initial position (FIG. 1).

Assuming that the compressed block has been formed from ingredients consisting of soil, from 5 to 10% cement, and water, the compressed block should be cured for an extended period of time, on the order of 10 to 20 days prior to its use as a building block. However, with the exception of the final cure, all of the manipulative steps necessary to form a finished block take place within the apparatus of the present invention, this apparatus being effective to compact, compress, and eject the block or brick.

Figure 4:
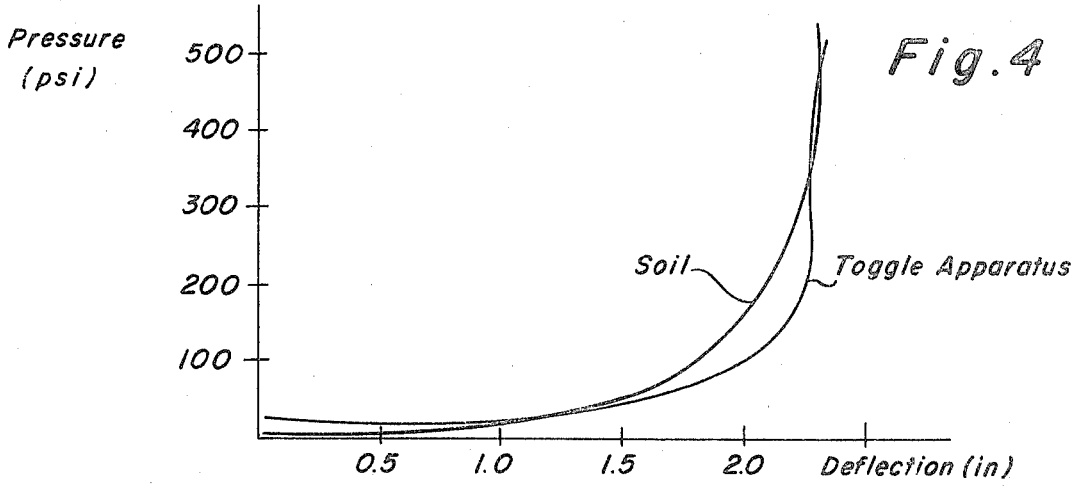
FIG. 4 is a typical curve of soil pressure vs plate deflection.

The apparatus 10 uses the above mechanism in such a way that it produces force when the soil requires force for compaction (FIG. 4). At the beginning of the cycle the toggle gives sizable deflection without much force. At the end of a cycle there is small deflection with a large driving force. Compressing soil has similar requirements. Initially, it deflects substantially with minimal forces. After some compaction has taken place it requires much higher forces for further compaction. The toggle is a good match for typical soils.

What is claimed is:

1. A hand powered block-making apparatus comprising a box for loading a soil-cement mixture therein, partially slotted supports for the box, a cover to hold the soil-cement mixture in the box during compression, a sliding plate which compresses the soil-cement mixture in the box and which also elevates a compressed block of said mixture out of the box, said plate being raised to compress the soil-cement mixture by toggle linkages on all supports, said toggle linkages comprising upper and ower links, the upper links being connected to the sliding plate and the lower links being slidably retained in the slots of the supports, said toggle linkages also being connected to toggle connecting bars joined to pivot wings, said pivot wings being connected to a pivot bar supported off the box and connected to a lever which is actuated by a handle on one side of the apparatus whereby downward swinging of the handle causes the pivot bar to extend the toggle links and compress the soil-cement mixture between the cover and the sliding plate and which also locks an ejector linkage, said linkage comprising an upper link connected to the sliding plate and a bottom link connected to the lever wherein subsequent upward swinging of the handle causes the lever to raise the ejector linkage and the extended toggle links in the slots of the supports, thereby ejecting the compressed soil-cement block, and an eccentric spring loaded cam positioned on the pivot support bar adjacent to the lower link of the ejector linkage, which through rotation of said cam unlocks the ejector linkage causing the sliding plate with connected toggle linkages to fall by gravity to its initial position.

2. Apparatus of claim 1, including a housing from the bottom of the box to the bottom of the supports and covering all the toggle linkages.

* * * * *